United States Patent [19]

Myers

[11] Patent Number: 5,067,586

[45] Date of Patent: Nov. 26, 1991

[54] SAFETY GUARD APPARATUS

[76] Inventor: James H. Myers, 11 Downview Park, Greenisland, County Antrim BT38 8RY, Northern Ireland

[21] Appl. No.: 510,218

[22] Filed: Apr. 17, 1990

[51] Int. Cl.[5] ..... E04G 3/12

[52] U.S. Cl. ..... 182/45; 182/82; 182/113; 248/237

[58] Field of Search ..... 182/45, 82, 113; 248/237, 235

[56] References Cited

U.S. PATENT DOCUMENTS

| | | | |
|---|---|---|---|
| 232,556 | 9/1880 | Slvius | 248/237 |
| 401,636 | 4/1889 | Brace | 248/237 |
| 499,826 | 6/1893 | Farland | 248/237 |
| 2,275,014 | 3/1942 | Hahler | 182/45 |
| 3,752,262 | 8/1973 | Helms | 182/113 |

FOREIGN PATENT DOCUMENTS

| | | | |
|---|---|---|---|
| 106750 | 2/1899 | Fed. Rep. of Germany | 182/45 |
| 115572 | 12/1900 | Fed. Rep. of Germany | 248/237 |
| 610173 | 10/1960 | Italy | 182/45 |
| 8800985 | 11/1989 | Netherlands | 182/45 |
| 651175 | 3/1951 | United Kingdom | 182/45 |
| 272891 | 10/1989 | United Kingdom | 182/45 |

*Primary Examiner*—Reinaldo P. Machado
*Attorney, Agent, or Firm*—Armstrong, Nikaido, Marmelstein, Kubovcik & Murray

[57] ABSTRACT

A safety guard apparatus for use on a pitched roof includes two or more units having a first member attached to a roof member and second and third members serving as an upright guard rail support. A distal end of the first member has fixed thereto a tubular collar having an axis at a right angle to the first member, and a fourth rigid elongate member is adjustably slidably fitted through the collar so that a lower end thereof may abut a vertical wall below the roof to support the apparatus above the roof.

15 Claims, 3 Drawing Sheets

SAFETY GUARD APPARATUS

This invention relates to safety guard apparatus for use primarily, but not exclusively, with pitched roofs whereby to provide means to prevent a worker or workers slipping or falling from a roof fitted therewith.

Accordingly, one aspect of the present invention is safety guard apparatus comprising two or more units to be spaced apart and secured together by a rail fastened to each unit, each unit having a first elongate member with second and third elongate members pivotally mounted in spaced relation thereon to be interconnectible together, the first member having at one end fastening means by which the unit can be supported with the second member serving as a tie for the third member which serves as an upright guard rail support.

Further accordingly, a second aspect of the present invention is in or for a safety guard apparatus a unit having a first elongate member with second and third elongate members pivotally mounted in spaced relation thereon to be interconnectible together, the first member having at one end fastening means by which the unit can be supported with the second member serving as a tie for the third member which serves as an upright guard rail support.

Preferably, the first elongate member has at the opposite end thereof and at right angles thereto a collar through which a fourth elongate member is in sliding engagement. The fourth member has preferably a lengthwise series of apertures to be aligned one at a time with an aligned set of apertures in the collar and secured by a pin or bolt located therethrough to hold them in said position whereby the fourth member can be length-adjusted relative to the first member. The outer end of the third member is preferably provided with a guard rail fastening mechanism. Also, means are preferably provided on the third member to hold a plank upright on side. The fourth member has preferably an angled foot plate at its lower end. The plate is preferably masked by a pad of protective material, such as rubber or a synthetic equivalent.

Preferably also, the second member serving as the tie is formed of two spaced bars between which the third member slides. The two bars are preferably secured with a spacer at both ends. The third member has an aperture transversely therethrough and the second member has a lengthwise series of aligned sets of apertures one set of which at any one time is aligned with the third member aperture and secured by a pin or bolt being located therethrough.

Preferably further, the fastening means on the first member is a hook to engage over, for example a rung of a ladder or a batten fixed to a roof. The fastening means may preferably also include a strap hinged to the one end of the first member and having at its outer end a thumb-screw held captive therethrough, the head of the screw having an aperture through which, for example a spindle or shank of a screwdriver can pass for use in rotating the screw into, for example a batten.

An embodiment of the present invention will now be described, by way of example, with reference to the accompanying drawings, in which.

Figure 3:
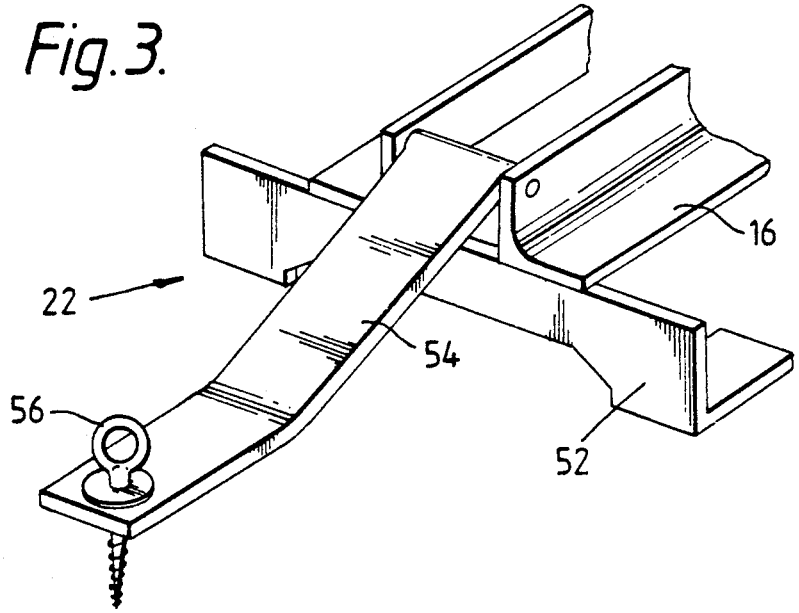
FIG. 3 shows a perspective view of the modification shown in FIG. 2 to a larger scale.
Figure 4:
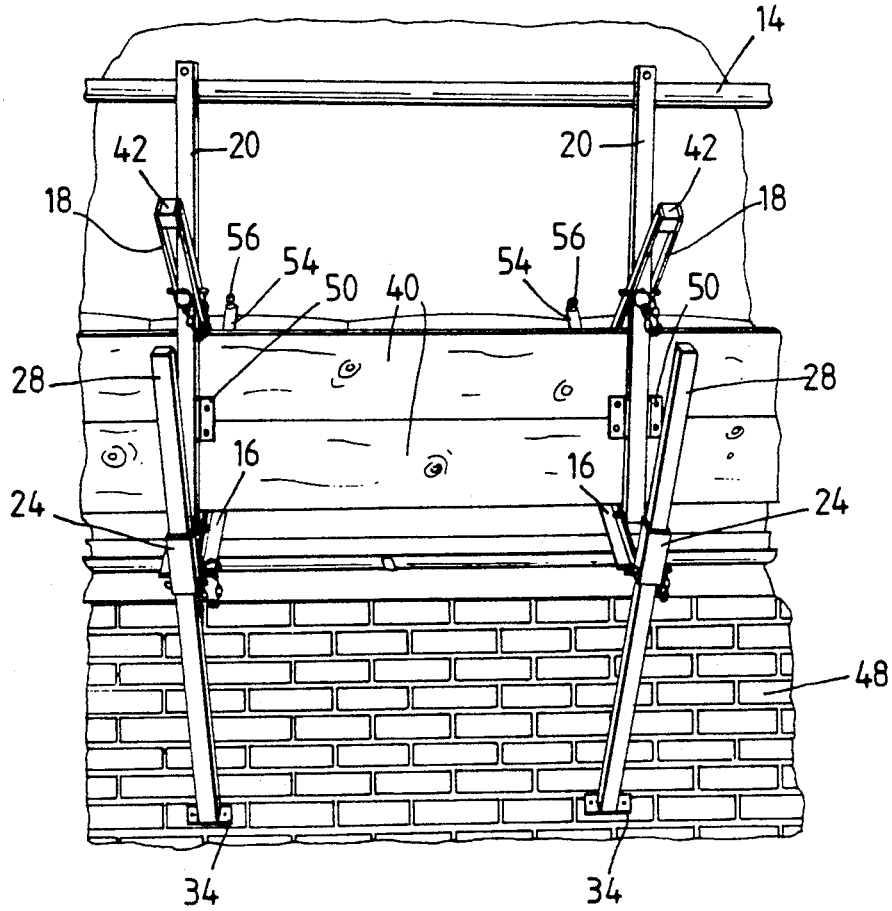
FIG. 4 shows a frontal view of two units mounted on a roof.

Referring to the drawing, safety guard apparatus comprises two or more units 10 to be spaced apart lengthwise of the roof 12 as shown in FIG. 4 and secured together by a rail 14 fastened to each unit 10. Each unit 10 has a first elongate member 16 with second and third elongate members 18, 20 pivotally mounted in longitudinal spaced relation thereon to be interconnectible together. The first member is formed by two spaced angle sections as can be seen in FIGS. 3 and 4, the uprights of the sections being contiguous and parallelly spaced apart a distance slightly greater than the width of the second and third members. The first member 16 has at one end fastening means 22 by which the unit is supported, and at the opposite end thereof and at right angles thereto a collar 24. The collar 24 is provided with a lengthwise series of aligned sets of apertures 26 at opposite locations as shown.

A fourth elongate member 28 is in sliding engagement with said collar 24 and is provided to act as a stay to abut against a vertical wall 48 supporting the roof. The fourth member 28 is of square tubular cross-section and has a lengthwise series of apertures 30 at opposite locations to be aligned one at a time with any one of the aligned sets of apertures 26 of the collar 24 into which a bolt 32 is located whereby the lengths of the fourth member on each side of the collar can be adjusted relative to the first member 16. The spacings between the apertures 30 is greater than those between the apertures 26. The collar 24 as shown is of rectangular cross-section in a transverse axis, but the cross-section can be of any suitable cross-section to be complementary to the cross-section of the fourth member. The fourth member 28 has an angled foot plate 34 at the end intended to abut against the vertical wall 48. The outside face of the plate 34 is masked by a pad 36 of protective material, such as rubber or synthetic equivalent.

Figure 2:
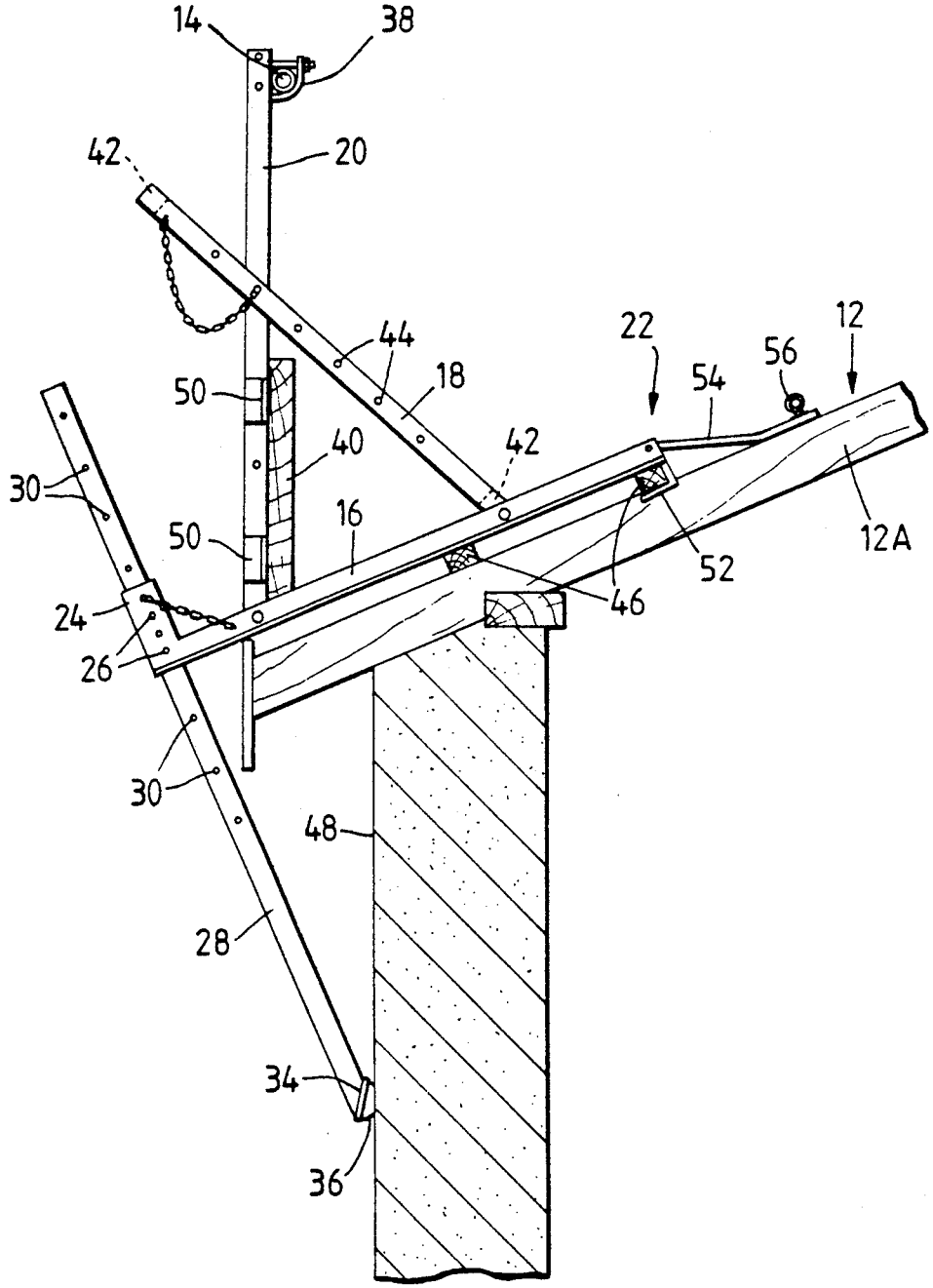
FIG. 2 shows a side elevation from the opposite side of a unit of the safety guard apparatus including a modification.

The outer end of the third member 20 is provided with a guard rail fastening mechanism 38. Means in the form of lugs 50 (FIGS. 2, 4) are provided laterally of the third member 20 to hold a plank 40 upright on its side. Apertures are provided in the lugs through which screw fastenings can be screwed into the plank 40 to retain it upright against the third members.

The second member 18 serves as a tie and is formed of two spaced bars between which the third member 20 can slide. The two bars are secured with a spacer 42 at both ends. The third member 20 has an aperture transversely therethrough and the second member 18 has a lengthwise series of aligned sets of apertures 44 in its two bars, any one of which aligned sets is alignable with the third member aperture.

The fastening means 22 on the first member 16 is a hook formation 52 to engage over for example a rung of a ladder or, as shown, a batten 46 fixed to the roof 12.

Figure 1:
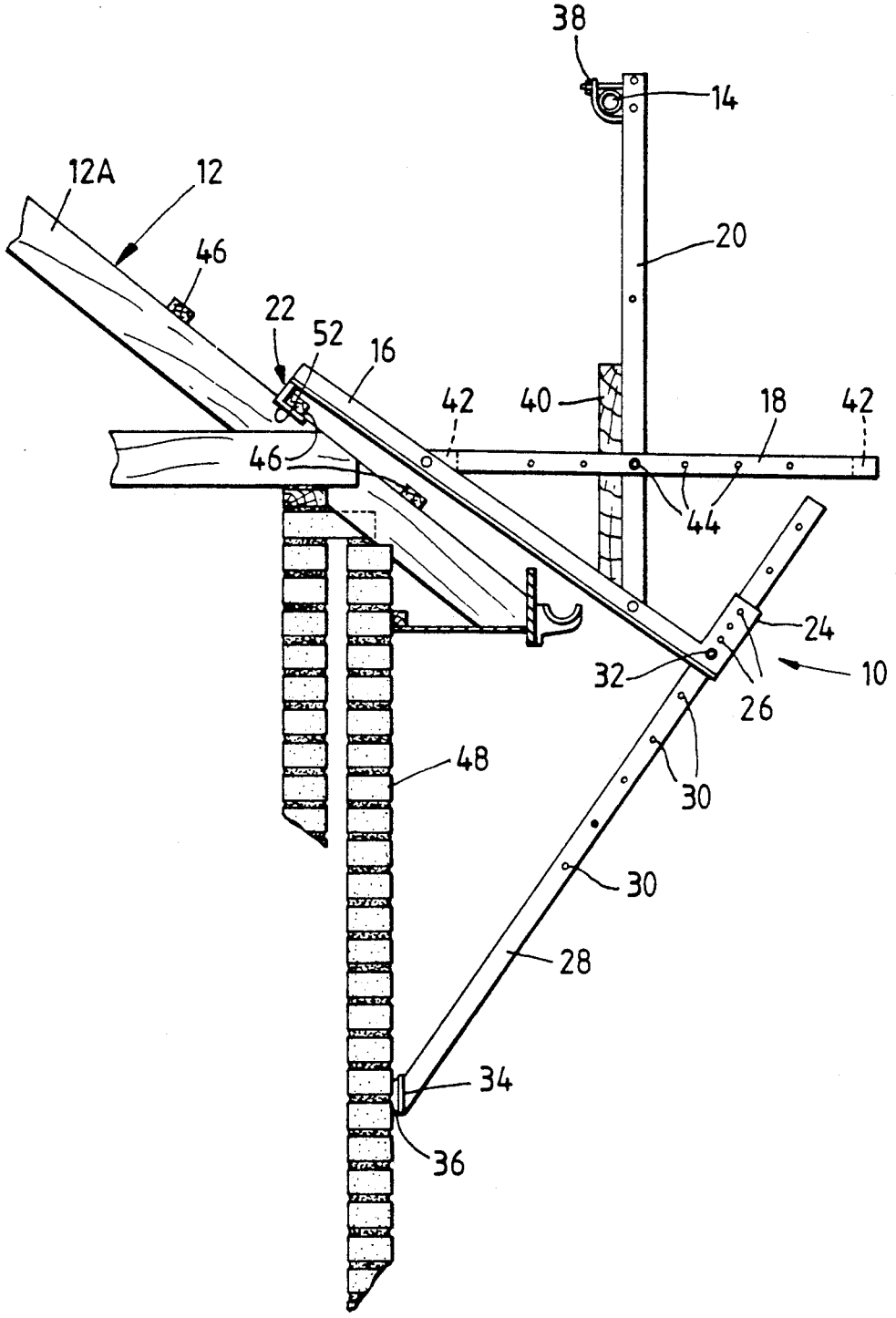
FIG. 1 shows a side elevation of a unit of the safety guard apparatus according to the present invention fitted to a roof.

To erect a guard rail, two or more units 10 are similarly erected adjacent to the bottom of the roof 12 as shown, and a rail 14 is secured to the fastening mechanism 38 of each unit. The hook formation 52 of each unit is engaged over a batten 46 as shown, preferably adjacent to a roof rafter 12A to which the batten is fastened, and fourth member 28 is adjusted in the collar 24 so that the pad 36 abuts against a wall 48 supporting the roof. The planks 40 are positioned upright on side as shown and screw fastened to the lugs 50 if required. With the first member 16 inclined, the second member 18 serves as a substantially horizontal tie as shown in FIG. 1 for the third member 20 which serves as an upright guard rail support. If desired, planks may be laid on top of the second members 18. The hook formation 52 is as particularly shown in FIG. 3 with two hooks, the width between these hooks being slightly greater than the width of the roof rafter and the hooks can be positioned one on each side of the roof rafter 12A, the bridge between the hooks being shaped to fit around the rafter.

In a first modification, the fastening means also includes a strap 54 hinged to the one end of the first member 16 and having at its outer end an aperture having a thumb-screw 56 held captive therethrough. The head of the screw 56 has an aperture, as shown in FIG. 3, through which, for example a spindle or shank of a screwdriver can pass for use in rotating the screw into, for example a batten.

In a second modification, the fourth member is not used and the collar at the opposite end of the first member in each unit has a pad of rubber or equivalent synthetic material fitted into its bottom end. The first member is of greater length and the hook is fashioned to fit over the ridge of a pitched roof whereby to give support to each unit. The first member may be of one piece construction, or may be of two-piece telescopic length-adjustable construction, the pieces being secured together by a pin or bolt engaging in aligned apertures in both pieces.

The apparatus can also be used with two or more spaced apart roof ladders i.e. conventional ladders having a transverse bar or plate attached at its upper end whereby it can be engaged over the ridge of the roof, with the hooks of the units engaging over rungs of the ladders. Also, the apparatus can be used with two spaced apart conventional ladders leaning against a tall wall. In this latter case, planks to walk along are placed on top of the second members. Obviously, the bottom end of the ladders require to be adequately secured against slippage.

Variations and modifications can be made without departing from the scope of the invention.

I claim:

1. A safety guard apparatus comprising:

two or more units to be spaced apart on a pitched roof and secured together by a rail fastened to each unit, each unit having a first elongate member with a second and a third elongate member mounted in spaced relation thereon and pivotally connected thereto, said second and third members being interconnectible together, each first member having at one end fastening means by which the unit can be supported on a roof member with its second member serving as a tie for the third member which serves as an upright guard rail support;

said first members each having a tubular collar rigidly fixed thereto at an end opposite said fastening means with a tubular axis of said collar at a right angle to the first member; and a fourth rigid elongate member engaged through and in sliding engagement with each said tubular collar, each said fourth member being positionally adjustable with respect to its collar such that a lower end thereof may abut a vertical wall below said pitched roof to support its respective unit above said roof.

2. A safety guard apparatus for a pitched roof comprising:

a unit having a first elongate member with second and third elongate members pivotally mounted in spaced relation thereon, said second and third members being interconnectible together, the first member having at one end fastening means by which the unit can be supported on a roof member with said second member serving as a tie for the third member which serves as an upright guard rail support;

said first member having a tubular collar rigidly fixed thereto at an end opposite said fastening means with a tubular axis of said collar at a right angle to the first member; and a fourth rigid elongate member engaged through and in sliding engagement with said tubular collar, said fourth member being positionally adjustable with respect to said collar such that a lower end thereof may abut a vertical wall below said pitched roof to support said unit above said roof.

3. Apparatus as claimed in claims 1 or 2, wherein the fourth member has a lengthwise series of apertures to be aligned one at a time with an aligned set of apertures in the collar and secured by a pin or bolt located therethrough to hold them in said position whereby the fourth member can be length-adjusted relative to the first member.

4. Apparatus as claimed in claims 1 or 2, wherein the outer end of the third member is provided with a guard rail fastening mechanism.

5. Apparatus as claimed in claims 1 or 2, wherein means are provided on the third member to hold a plank upright on side.

6. Apparatus as claimed in claim 5, wherein the means are in the form of lugs extending laterally out from the third member.

7. Apparatus as claimed in claim 6, wherein the lugs are apertured to accept screw fastenings therethrough to be screwed into the plank.

8. Apparatus as claimed in claims 1 or 2, wherein the fourth member has an angled foot plate at its lower end.

9. Apparatus as claimed in claim 8, wherein the plate is masked by a pad of protective material, such as rubber or a synthetic equivalent.

10. Apparatus as claimed in claims 1 or 2, wherein the second member serving as the tie is formed of two spaced bars between which the third member slides.

11. Apparatus as claimed in claim 10, wherein the two bars are secured with a spacer at both ends.

12. Apparatus as claimed in claims 1 or 2, wherein the third member has an aperture transversely therethrough and the second member has a lengthwise series of aligned sets of apertures one set of which at any one time is aligned with the third member aperture and secured by a pin or bolt being located therethrough.

13. Apparatus as claimed in claims 1 or 2, wherein the fastening means on the first member is a hook formation to engage over, for example a rung of a ladder or a batten fixed to a roof.

14. Apparatus as claimed in claim 13, wherein the fastening means also includes a strap hinged to the one end of the first member and having at its outer end a thumb-screw held captive therethrough.

15. Apparatus as claimed in claim 14, wherein the head of the screw has an aperture through which, for example a spindle or shank of a screwdriver can pass for use in rotating the screw into, for example a batten.

* * * * *